US011657796B2

(12) United States Patent
Jin et al.

(10) Patent No.: US 11,657,796 B2
(45) Date of Patent: May 23, 2023

(54) ACTIVE CONTROL METHOD FOR FILTERED REFERENCE AFFINE PROJECTION SIGN ALGORITHM BASED ON VARIABLE STEP SIZE

(71) Applicant: Harbin Engineering University, Harbin (CN)

(72) Inventors: Guoyong Jin, Harbin (CN); Shanjun Li, Harbin (CN); Tiangui Ye, Harbin (CN)

(73) Assignee: HARBIN ENGINEERING UNIVERSITY, Harbin (CN)

( * ) Notice: Subject to any disclaimer, the term of this patent is extended or adjusted under 35 U.S.C. 154(b) by 15 days.

(21) Appl. No.: 17/564,822

(22) Filed: Dec. 29, 2021

(65) Prior Publication Data

US 2022/0392426 A1 Dec. 8, 2022

(30) Foreign Application Priority Data

Jun. 4, 2021 (CN) ..... 202110624450.8

(51) Int. Cl.
*G10K 11/178* (2006.01)

(52) U.S. Cl.
CPC .. *G10K 11/17815* (2018.01); *G10K 11/17819* (2018.01)

(58) Field of Classification Search
None
See application file for complete search history.

(56) References Cited

FOREIGN PATENT DOCUMENTS

CN 106603038 A * 4/2017 ..... H03H 21/0043
CN 106603038 A 4/2017

* cited by examiner

*Primary Examiner* — Walter F Briney, III
(74) *Attorney, Agent, or Firm* — WPAT, P.C

(57) ABSTRACT

An active control method for filtered reference affine projection sign algorithm based on variable step size includes: S1, acquiring impulse noise signals and transmitting the signals to control filters; S2, transmitting the impulse noise signals by the control filters to post filters; S3, generating cancellation signals of the impulse noise signals by the post filters according to the impulse noise signals and internal active control algorithms, and transmitting the cancellation signals to a speaker; S4, sending out the cancellation signal by the speaker to superimpose with the impulse noise signals to cancel the impulse noise signal. A convex combination structure and a variable step size strategy are adopted, and by adjusting step size coefficients in the control filter structure, convergence speed of algorithm is controlled, contradiction between convergence speed and steady-state error is coordinated, convergence performance of control algorithm to impulse noises is improved, and impulse noises are effectively controlled.

2 Claims, 3 Drawing Sheets

ACTIVE CONTROL METHOD FOR FILTERED REFERENCE AFFINE PROJECTION SIGN ALGORITHM BASED ON VARIABLE STEP SIZE

TECHNICAL FIELD

The invention belongs to the field of active control of noise, in particular to an active control method for filtered reference affine projection sign algorithm based on variable step size.

BACKGROUND

Impulse noise which obeys non-Gaussian distribution exists widely in the real environment, and the performance of the conventional adaptive algorithm based on the second moment theory could decline or even deteriorate. With the application of active noise control technology and the development of active noise control algorithm, an affine projection sign algorithm based on 1-norm is produced, which combines affine projection algorithm and sign algorithm to effectively control impulse noise and improve the performance of the algorithm in environment with impulse noise. The active control method with a post filter and filtered reference affine projection sign algorithm not only considers the secondary path in actual noise control, but also can flexibly adjust the contradiction between convergence speed and steady-state error. However, the algorithm has fixed convergence step size, so that the convergence performance of the algorithm needs to be further improved.

SUMMARY

The objectives of the invention are to solve the above problem that the fixed step size in the active control method with a post filter and filtered reference affine projection sign algorithm hinders the further improvement of the convergence performance of the algorithm, and to provide an active control method for filtered reference affine projection sign algorithm based on variable step size, which can ensure the stability of the control method, improve the convergence performance in the impulsive noise environment, and effectively reduce the impulsive noise.

To achieve the above objective, the invention provides the following scheme: an active control method for filtered reference affine projection sign algorithm based on variable step size includes the following steps:

S1, acquiring impulse noise signals and transmitting the impulse noise signals to control filters, wherein the control filters include a first control filter and a second control filter;

S2, the control filter transmitting the impulse noise signals to post filters, wherein the post filters include a first post filter and a second post filter;

S3, the post filters generating cancellation signals of the impulse noise signals according to the impulse noise signals and internal active control algorithms, and transmitting the cancellation signals to a speaker;

S4, the speaker sending out the cancellation signals, which are superimposed with the impulse noise signals to cancel the impulse noise signals.

Preferably, the impulse noise signals include a first input signal, a second input signal, a third input signal, a fourth input signal, a fifth input signal and a sixth input signal.

Preferably, the third input signal passes through a primary path module to obtain a first desired signal; and the fourth input signal passes through the primary path module to obtain a second desired signal.

Preferably, based on the first control filter, the second input signal is used as an input, and a first output signal is obtained through the first post filter and a secondary path module; and based on the second control filter, taking the fifth input signal as an input, a second output signal is obtained through the second post filter and another secondary path module.

Preferably, based on the first output signal and the first desired signal, a first posterior error signal is obtained, and the first posterior error signal is the error signal of the first control filter; and a second posterior error signal is obtained based on the second output signal and the second desired signal, and the second posterior error signal is the error signal of the second control filter.

Preferably, a first filtered reference signal is obtained by the first input signal passing through an estimated secondary path module; and a second filtered reference signal obtained by the sixth input signal passing through another estimated secondary path module.

Preferably, the first posterior error signal and the first filtered reference signal are configured (i.e., structured and arranged) to update a weight coefficient of the first control filter; and the second posterior error signal and the second filter reference signal are configured to update a weight coefficient of the second control filter.

Preferably, a third output signal is obtained based on the first output signal and a first mitigation coefficient;

a fourth output signal is obtained based on the second output signal and a second mitigation coefficient; and a total output signal of a control system is obtained based on the third output signal and the fourth output signal.

Preferably, a third posterior error signal is obtained based on the first posterior error signal and the first mitigation coefficient;

a fourth posterior error signal is obtained based on the second posterior error signal and the second mitigation coefficient; and a total error signal of the control system is obtained based on the third posterior error signal and the fourth posterior error signal.

Preferably, the total error signal and the first desired signal are used to update a first variable step size of the first control filter;

the total error signal and the second desired signal are used to update a second variable step size of the second control filter.

The invention may have the following advantages:

A convex combination structure and variable step size strategy are introduced not only to ensure good stability of the algorithm, but also to further improve the convergence performance of the algorithm due to the fixed step size in the active control method with a post filter and filtered reference affine projection sign algorithm. By adjusting the step size coefficient in the control filter structure, controlling the convergence speed of the algorithm, coordinating the contradiction between the convergence speed and steady-state error to improve the convergence performance of the control algorithm, and achieve the objective of effectively controlling impulse noise.

BRIEF DESCRIPTION OF THE DRAWINGS

In order to more clearly explain the embodiments of the invention or the technical schemes in the prior art, the drawings needed in the embodiments will be briefly introduced below. Apparently, the drawings in the following descriptions are only some embodiments of the invention, and for those of ordinary skill in the art, other drawings can be obtained according to these drawings without creative efforts.

DETAILED DESCRIPTION OF EMBODIMENTS

The technical scheme in the embodiment of the invention will be clearly and completely described with reference to the drawings in the embodiment of the invention. Apparently, the described embodiments are only part of the embodiments of the invention, not all of them. Based on the embodiments in the invention, all other embodiments obtained by those of ordinary skill in the art without creative effort are within the scope of the invention.

In order to make the above-mentioned objects, features and advantages of the invention more obvious and easier to understand, the invention will be described in further detail below with reference to the drawings and detailed description.

Figure 1:
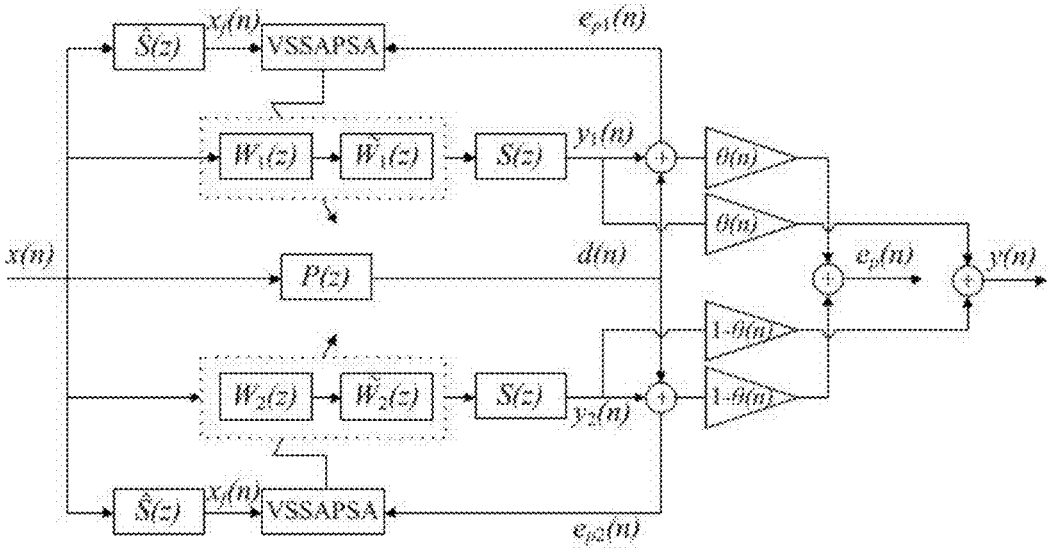
FIG. 1 is a control algorithm block diagram of an active control method for filtered reference affine projection sign algorithm based on variable step size according to an embodiment of the invention.

As shown in FIG. 1, this embodiment provides an active control method for filtered reference affine projection sign algorithm based on variable step size, which is realized by the following technical scheme:

collect the impulse noise signals and transmit the signals to the control filters; the impulse noise signals include a first input signal, a second input signal, a third input signal, a fourth input signal, a fifth input signal and a sixth input signal; the control filters include a first control filter and a second control filter; the control filters then transmit the impulse noise signals to the post filters, which include a first post filter and a second post filter; the post filters generate the cancellation signals of the impulse noise signals according to the impulse noise signals and internal active control algorithms, and transmit the cancellation signals to the speaker; the speaker sends out cancellation signals, which are superimposed with the impulse noise signals to cancel the impulse noise signals.

Further, the third input signal passes through the primary path module to obtain the first desired signal; the fourth input signal passes through the primary path module to obtain the second desired signal.

Based on the first control filter, taking the second input signal as input, the first output signal is obtained through the first post filter and the secondary path module; based on the second control filter, taking the fifth input signal as input, and the second output signal is obtained through the second post filter and the secondary path module.

A first posterior error signal is obtained based on the first output signal and the first desired signal, wherein the first posterior error signal is the error signal of the first control filter; a second posterior error signal is obtained based on the second output signal and the second desired signal, wherein the second posterior error signal is the error signal of the second control filter.

The first input signal passes through an estimated secondary path module to obtain a first filtered reference signal; the sixth input signal passes through the estimated secondary path module to obtain a second filtered reference signal.

The first posterior error signal and the first filtered reference signal are used to control the updating of the weight coefficient of the first control filter; the second posterior error signal and the second filtered reference signal are used to control the updating of the weight coefficient of the second control filter.

A third output signal is obtained based on the first output signal and the first mitigation coefficient; a fourth output signal is obtained based on the second output signal and the second mitigation coefficient; a total output signal of the control system is obtained based on the third output signal and the fourth output signal.

A third posterior error signal is obtained based on the first posterior error signal and the first mitigation coefficient; a fourth posterior error signal is obtained based on the second posterior error signal and the second mitigation coefficient; a total error signal of the control system is obtained based on the third posterior error signal and the fourth posterior error signal.

The total error signal and the first desired signal are used to control the iterative update of the first variable step size of the first control filter; the total error signal and the second desired signal are used to control the iterative update of the second variable step size of the second control filter.

The specific embodiments of the invention will be further described with reference to the drawings and examples below.

FIG. 1 is a block diagram of the control algorithm of the active control method for filtered reference affine projection sign algorithm based on variable step size, which uses feed forward control structure. The control filter refers to the active control method with a post filter and filtered reference affine projection sign algorithm, and adopts the convex combination structure and variable step size strategy. By adjusting the step size coefficients in the two control filter structures, the convergence performance of the algorithm can be controlled, the contradiction between convergence speed and steady-state error can be coordinated, and the objective of effectively controlling impulse noise can be achieved.

Reference signalsx(n) (impulse noise signal) in FIG. 1 pass through a primary path module/modelP(z) to obtain the desired signalsd(n). The control filter $W_1(z)$ takes the reference signal x(n) as input, and generates the output signal $y_1(n)$ after passing through the post filter $\tilde{W}_1(z)$ and a secondary path model S(z); the control filter $W_2(z)$ takes the reference signal x(n) as its input, and generates the output signal $y_2(n)$ after passing through the post-filter $\tilde{W}_2(z)$ and another secondary path model S(z). The output signal $y_1(n)$ and the desired signal d(n) synthesize the posterior error signal $e_{p1}(n)$, and the output signal $y_2(n)$ and the desired signal d(n) synthesize the posterior error signal $e_{p2}(n)$. The posterior error signals $e_{p1}(n)$ and $e_{p1}(n)$ are respectively used as the error signals of their respective control filters, and together with the reference signalsx(n) filtered by estimated secondary path models$\hat{S}(z)$, participate in the weight coefficient updating of the control filters $W_1(z)$ and $W_2(z)$, respectively. The control filters with updated weight coefficients then take the reference signal as input to generate output signals, and so on.

Output signal $y_1(n)$ multiplied by mitigation coefficient $\theta(n)$ at time n and output signal $y_2(n)$ multiplied by mitigation coefficient $1-\theta(n)$ at time n are superimposed to generate a total output signal y(n) of control system. The posterior error signal $e_{p1}(n)$ multiplied by the relaxation/mitigation coefficient $\theta(n)$ at time n and the posterior error signal $e_{p2}(n)$ multiplied by the relaxation/mitigation coefficient $1-\theta(n)$ at time n are superimposed to generate a total posterior error signal $e_p(n)$. The posterior error signal $e_p(n)$ is the error signal of the control system, and its power and powers of the desired signals d(n) participate in the iterative updates of variable step sizes $\mu_1(n)$ and $\mu_2(n)$ corresponding to the control filters $W_1(z)$ and $W_2(z)$. It is noted that, in some embodiments, the above described modules/models may be software modules stored in one or more memories and executable by one or more processors coupled to the one or more memories.

Figure 2:
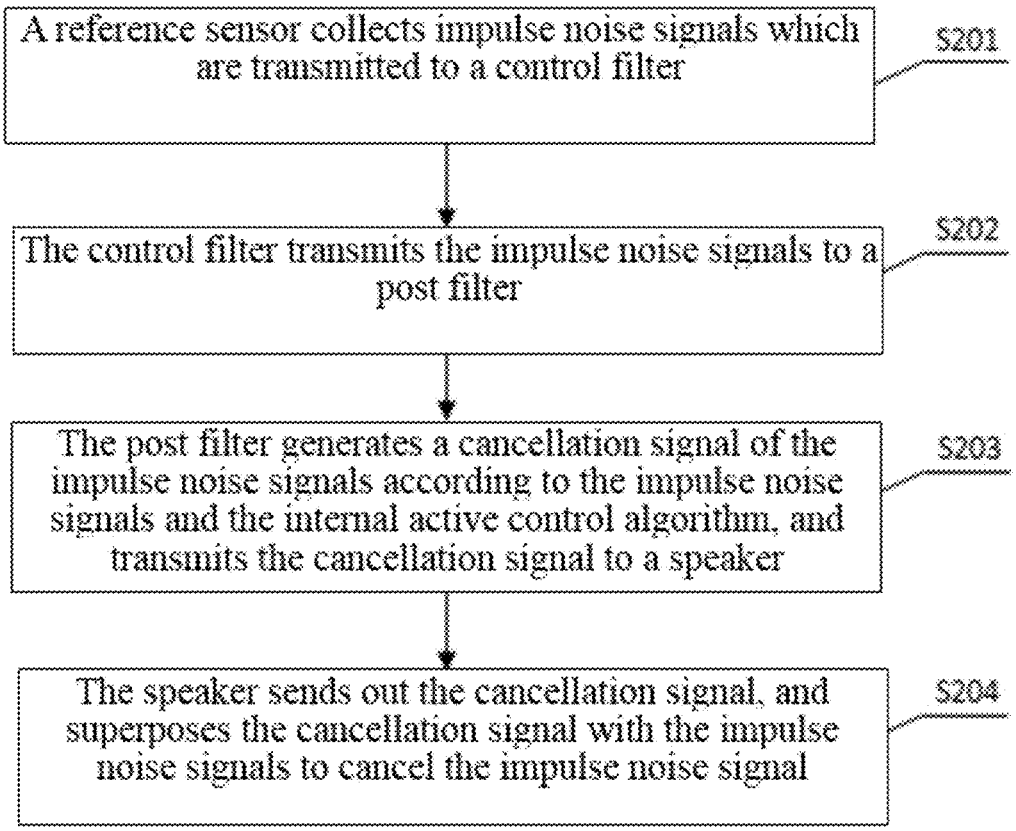
FIG. 2 is a flow chart of an active control method for filtered reference affine projection sign algorithm based on variable step size according to an embodiment of the invention.

FIG. 2 is a flow chart of an active control method for filtered reference affine projection sign algorithm based on variable step size according to an embodiment of the invention. As shown in FIG. 2, this embodiment provided by the invention is an active control method for filtered reference affine projection sign algorithm based on variable step size for active impulse noise control, which includes the following steps:

S201, a reference sensor collects impulse noise signals which are transmitted to a control filter;

S202, the control filter transmits the impulse noise signals to a post filter;

S203, the post filter generates a cancellation signal of the impulse noise signals according to the impulse noise signals and the internal active control algorithm, and transmits the cancellation signal to a speaker;

S204, the speaker sends out the cancellation signal, and superposes the cancellation signal with the impulse noise signals to cancel the impulse noise signal.

According to the invention, the weight coefficients of the control filters $W_1(z)$ and $W_2(z)$ are updated by introducing the convex combination structure and the time-varying step size into the active control method with a post filter and filtered reference affine projection sign algorithm. Among them, the update formulas of control filter weight coefficient include six parts: post filter weight coefficients of two controllers, posterior error terms and update of control filter weight coefficients, which not only ensures the stability of the algorithm, but also improves the convergence performance of the control algorithm to impulse noise.

The update formulas are as follows:

$$\tilde{w}_i(n) = (1-\gamma)w_i(n) + \gamma\tilde{w}_i(n-1) \tag{1}$$

$$e_{pi}(n) = d(n) + X_f^T(n)\tilde{w}_i(n) \tag{2}$$

$$w_i(n+1) = \tilde{w}_i(n) - \mu_i \frac{(1-\gamma)X_f(n)\mathrm{sgn}(e_{pi}(n))}{\sqrt{(1-\gamma)\mathrm{sgn}(e_{pi}^T(n))X_f^T(n)X_f(n)\mathrm{sgn}(e_{pi}(n))} + \epsilon} \tag{3}$$

in which, sgn(•) is the sign operation, $(\bullet)^T$ is the transpose operation, n is the time coefficient, i is the number of control filters, i=1, 2, $w_i(n+1)$ is the weight coefficient vector of the ith control filter at time n+1, $w_1(n)$ is the weight coefficient vector of the ith control filter at time n, $w_i(n)=[w_{i,0}(n), w_{i,1}(n), \ldots, w_{i,M-1}(n)]^T$, M is the length of the control filter, $\tilde{w}_i(n)$ is the weight coefficient vector of the ith post filter at time n, $\tilde{w}_i(n)=[\tilde{w}_{i,0}(n), \tilde{w}_{i,1}(n), \ldots, \tilde{w}_{i,M-1}(n)]^T$, $e_{pi}(n)$ is the weight vector at time n, $e_{pi}(n)=[e_{pi}(n), e_{pi}(n-1), \ldots, e_{pi}(n-K+1)]^T$, and K is the projection order. $X_f(n)$ is the k-order filtered reference signal vector at time n, $X_f(n)=[x_f(n), x_f(n-1), \ldots, x_f(n-K+1)]$, $X_f(n)$ is the filtered reference signal vector at time n, and $x_f(n)=[x_f(n), x_f(n-1), \ldots, x_f(n-M+1)]^T$, $x_f(n)=\hat{S}^T x_H(n)$, $\hat{S}$ is the estimated secondary path model; $x_H(n)$ is the reference signal vector at time n, $x_H(n)=[x(n), x(n-1), \ldots, x(n-H+1)]^T$, H is the secondary path length, d(n) is the desired signal vector at time n, $d(n)=[d(n), d(n-1), \ldots, d(n-K+1)]^T$, $\gamma$ is the weight factor in the post filter, $\mu$ is the iteration step size of the control filter, and $\epsilon$ is the normalization parameter.

The update formulas of variable step sizes are as follows:

$$A_d(n) = \beta A_d(n-1) + (1-\beta)|d(n)| \tag{4}$$

$$A_e(n) = \beta A_e(n-1) + (1-\beta)|e_p n)| \tag{5}$$

$$\mu_i(n) = \sigma_i \frac{A_e(n)}{A_d(n)} + \varepsilon \tag{6}$$

in which $\beta$ is the forgetting factor, |•| is the absolute value operator, d(n) is the desired signal at time n, $A_d(n)$ is the desired signal power at time n, $A_d(n-1)$ is the desired signal power at time n−1, $e_p(n)$ is the total a posterior error signal at time n, $e_p(n)=\theta(n)e_{p1}(n)+(1-\theta(n))e_{p2}(n)$, $e_{p1}(n)$ is the first posterior error signal at time n, and $e_{p2}(n)$ is the second posterior error signal at time n;$\theta(n)$ is the mitigation coefficient at time n, $$\theta(n) = \frac{1}{1+e^{-\alpha(n)}},$$

and e is a constant, taking 2.71828; $\alpha(n)$ is the mixed parameter at time n, $\alpha(n+1)=\alpha(n)+\rho_\alpha \mathrm{sgn}(e_p(n))(y_1(n)-y_2(n))\theta(n)(1-\theta(n))$, $\alpha(n+1)$ is the mixed parameter at time n+1, and $\rho_\alpha$ is a positive number, $y_1(n)$ is the output of the first control filter, $y_1(n)=x_f^T(n)\tilde{w}_1(n)$, $\tilde{w}_1(n)$ is the weight coefficient vector of the first postfilter at time n, $y_2(n)$ is the output of the second control filter, $y_2(n)=x_f^T(n)\tilde{w}_2(n)$,$\tilde{w}_2(n)$ is the first postfilter weight coefficient vector at time n; $A_e(n-1)$ is the posterior error signal power at time n−1, $A_e(n)$ is the posterior error signal power at time n, $\varepsilon$ is a positive parameter, $\sigma_1$ is the ith variable step size coefficient and $\mu_i(n)$ is the ith variable step size at time n.

In this embodiment, the following simulation conditions are set: the order of the filter is 64, the projection order is 5, the normalization parameter is 0.0001, the transfer function of the primary path is [0.0167 0.4833 0.4833 0.0167], the transfer function of the secondary path is [0.2037 0.5926 0.2037], the estimated secondary path model is the same as the transfer function of the secondary path, and the noise source is impulse noise which obeys the standard symmetric and stable distribution, in which the characteristic parameter $\alpha=1.8$.

Figure 3:
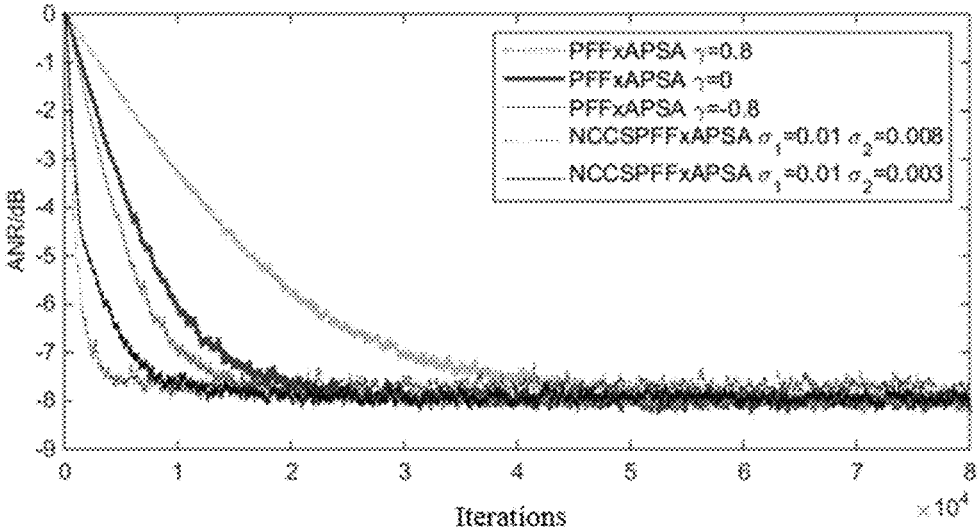
FIG. 3 is a comparison diagram of simulation results about convergence performance between the active control method for filtered reference affine projection sign algorithm based on variable step size according to the embodiment of the invention and the active control method with a post filter and filtered reference affine projection sign algorithm.

Set the iterative step size of the filter to 0.001, and compare the convergence performance of the active control method with a post filter and filtered reference affine projection sign algorithm when the weight factors $\gamma=-0.8$, $\gamma=0$ and $\gamma=0.8$ with the active control method of the filtered reference affine projection sign algorithm based on variable step size when the step size coefficients $\sigma_1=0.01$, $\sigma_2=0.008$ and $\sigma_1=0.01$ and $\sigma_2=0.003$, and the simulation results are shown in FIG. 3. PFFxAPSA represents the active control method with a post filter and filtered reference affine projection sign algorithm, and NCCSPFFPxAPSA represents the active control method for filtered reference affine projection sign algorithm based on variable step size. In the simulation, the weight factor of the active control method for filtered reference affine projection sign algorithm based on variable step size $\gamma=-0.8$, and the simulation results are the average results of 30 experiments. The simulation results show that the convergence performance of the active control method for filtered reference affine projection sign algorithm based on variable step size is better than that of the active control method with a post filter and filtered reference affine projection sign algorithm. At the same time, adjusting the step size coefficient of the active control method for filtered reference affine projection sign algorithm based on variable step size can coordinate the contradiction between convergence speed and steady-state error of the algorithm.

Figure 4:
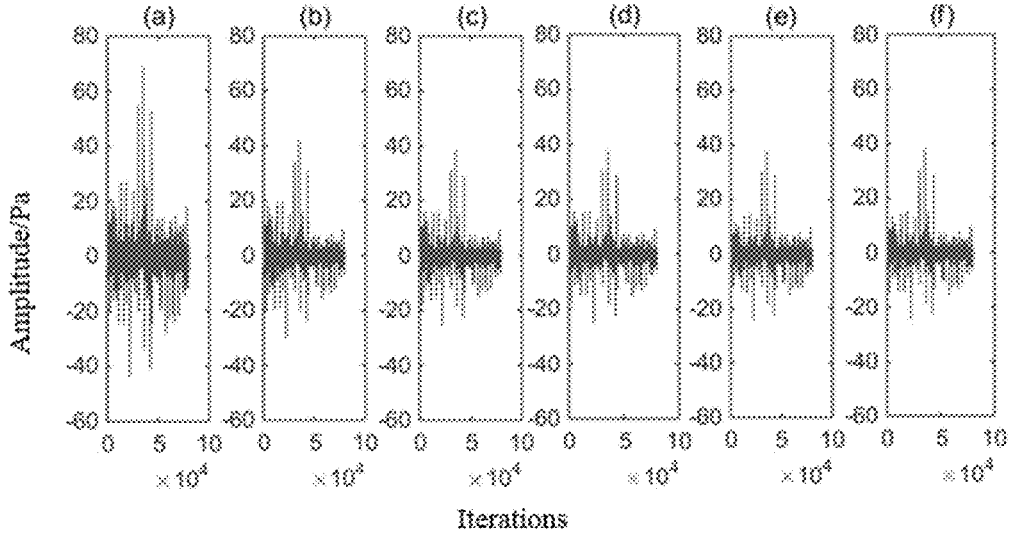
FIG. 4 is a comparison diagram of simulation results about noise reduction performance between the active control method for filtered reference affine projection sign algorithm based on variable step size according to the embodiment of the invention and the active control method with a post filter and filtered reference affine projection sign algorithm.
Figure 5:
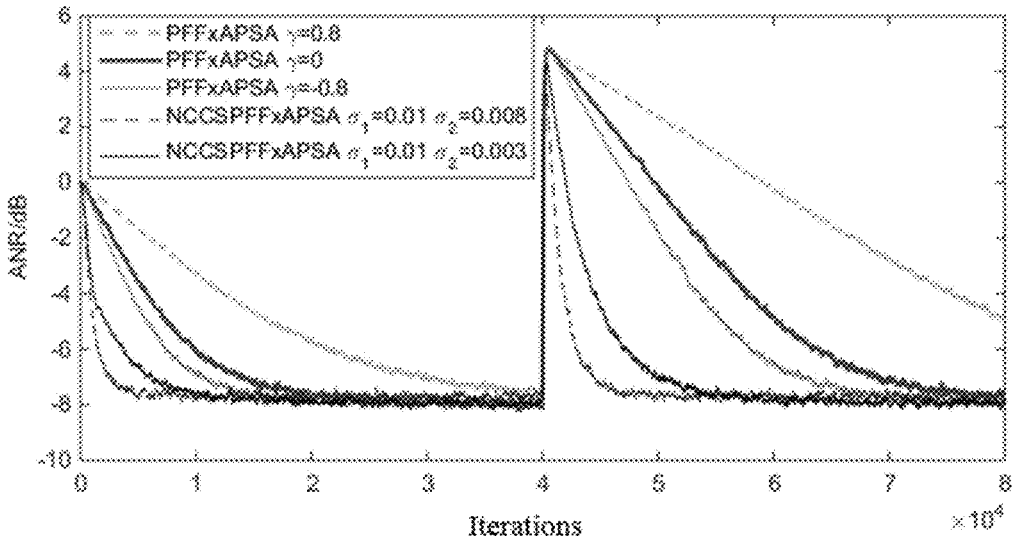
FIG. 5 is a comparison diagram of simulation results about tracking performance between the active control method for filtered reference affine projection sign algorithm based on variable step size according to the embodiment of the invention and the active control method with a post filter and filtered reference affine projection sign algorithm.
Figure 6:
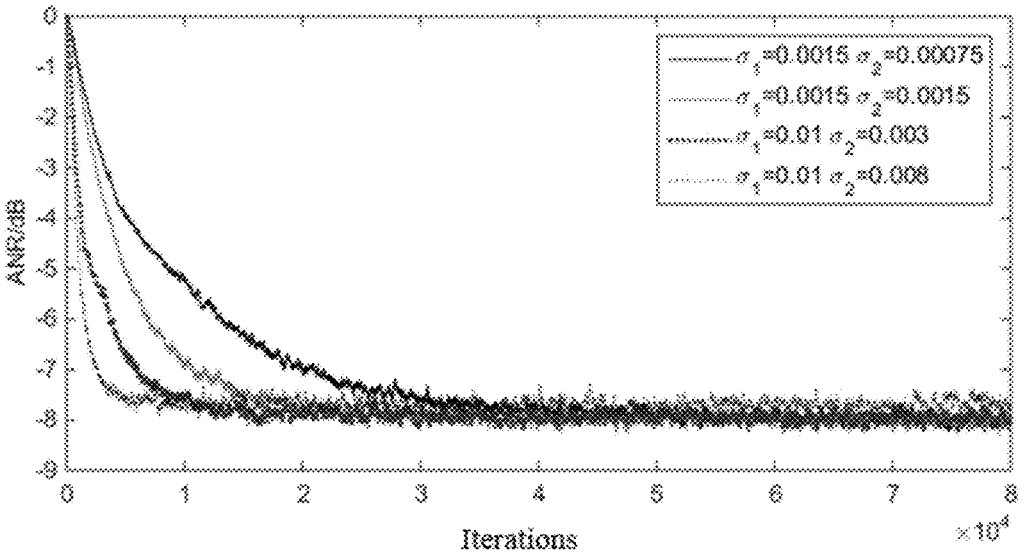
FIG. 6 is an algorithm convergence graph of active control method for filtered reference affine projection sign algorithm based on variable step size under different step size parameters according to an embodiment of the invention.

The simulation parameters are same as the above parameters, and the noise reduction performance is compared between the active control method with a post filter and filtered reference affine projection sign algorithm when the weight factor $\gamma=-0.8$, $\gamma=0$, and $\gamma=0.8$ and the active control method for filtered reference affine projection sign algorithm based on variable step size when the step size factor $\sigma_1=0.01$, $\sigma_2=0.008$ and $\sigma_1=0.01$, $\sigma_2=0.003$, and the simulation results are shown in FIG. 4. The simulation results show that the active control method for filtered reference affine projection sign algorithm based on variable step size has good noise reduction performance in impulse noise environment. In addition, when the primary path P(z) changes, the active control method for filtered reference affine projection sign algorithm with the weight factor $\gamma=-0.8$, $\gamma=0$ and $\gamma=0.8$ is compared with that with the step coefficient $\sigma_1=0.01$, $\sigma_2=0.008$ and $\sigma_1=0.01$ and $\sigma_2=0.003$. In the simulation, the primary path P(z) changes to −P(z) at 40000 iterations, and the simulation results are shown in FIG. 5. The simulation results show that the active control method for filtered reference affine projection sign algorithm based on variable step size when the step size coefficient $\sigma_1=0.01$, $\sigma_2=0.008$ and $\sigma_1=0.01$, $\sigma_2=0.003$, has better convergence performance than that of the active control method with a post filter and filtered reference affine projection sign algorithm when the weight factor $\gamma=-0.8$, $\gamma=0$ and $\gamma=0.8$. FIG. 6 shows the comparison between the convergence curves of the active control method for filtered reference affine projection sign algorithm based variable step-size after considering different step-size parameters. The simulation results show that adjusting the step-size coefficient in the weight update formula of convex combination filter can adjust the convergence performance of the algorithm. Within a certain range, with the increase of the two step-size coefficients, the convergence speed is faster.

By adopting the convex combination structure and the variable step size strategy, the invention solves the problem that the convergence performance of the algorithm is hindered by fixed step size in the active control method with a post filter and filtered reference affine projection sign algorithm while ensuring the stability of the algorithm. According to the invention, by adjusting the step size coefficient in the control filter structure, controlling the convergence speed of the algorithm, coordinating the contradiction between the convergence speed and the steady-state error, improving the convergence performance of the control algorithm to impulse noise, and thus effectively controlling impulse noise.

The above embodiments only describe preferred modes of the invention, but do not limit the scope of the invention. Without departing from the design spirit of the invention, all kinds of modifications and improvements made by those of ordinary skill in the field to the technical scheme of the invention should fall within the protection scope determined by the appended claims of the invention.

What is claimed is:

1. An active control method for filtered reference affine projection sign algorithm based on variable step size, comprising the following steps:

S1, acquiring impulse noise signals and transmitting the impulse noise signals to control filters, wherein the control filters comprise a first control filter and a second control filter;

S2, transmitting the impulse noise signals by the control filters to post filters, wherein the post filters comprise a first post filter and a second post filter;

S3, generating cancellation signals of the impulse noise signals by the post filters according to the impulse noise signals and internal active control algorithms, and transmitting the cancellation signals to a speaker; and S4, sending out the cancellation signals by the speaker, and thereby the cancellation signals being superimposed with the impulse noise signals to cancel the impulse noise signals;

wherein the impulse noise signals comprise a first input signal, a second input signal, a third input signal, a fourth input signal, a fifth input signal and a sixth input signal;

wherein the third input signal passes through a primary path module to obtain a first desired signal; and the fourth input signal passes through the primary path module to obtain a second desired signal;

wherein based on the first control filter, the second input signal is used as an input, and a first output signal is obtained through the first post filter and a secondary path module; and based on the second control filter, the fifth input signal is used as an input, and a second output signal is obtained through the second post filter and another secondary path module;

wherein based on the first output signal and the first desired signal, a first posterior error signal is obtained, and the first posterior error signal is an error signal of the first control filter; and based on the second output signal and the second desired signal, a second posterior error signal is obtained, and the second posterior error signal is an error signal of the second control filter;

wherein a first filtered reference signal is obtained by the first input signal passing through an estimated secondary path module; and a second filtered reference signal is obtained by the sixth input signal passing through another estimated secondary path module;

wherein the first posterior error signal and the first filtered reference signal are configured to update a weight coefficient of the first control filter; and the second posterior error signal and the second filtered reference signal are configured to update a weight coefficient of the second control filter;

wherein a third output signal is obtained based on the first output signal and a first mitigation coefficient; a fourth output signal is obtained based on the second output signal and a second mitigation coefficient; and a total output signal of a control system is obtained based on the third output signal and the fourth output signal; and wherein a third posterior error signal is obtained based on the first posterior error signal and the first mitigation coefficient; a fourth posterior error signal is obtained based on the second posterior error signal and the second mitigation coefficient; and a total error signal of the control system is obtained based on the third posterior error signal and the fourth posterior error signal.

2. The active control method according to claim 1, wherein the total error signal and the first desired signal are configured to update a first variable step size of the first control filter; and the total error signal and the second desired signal are configured to update a second variable step size of the second control filter.

* * * * *